US010859220B2

(12) United States Patent
Hollander et al.

(10) Patent No.: US 10,859,220 B2
(45) Date of Patent: Dec. 8, 2020

(54) MULTI-FUNCTION LIGHTING FIXTURE

(71) Applicant: Hubbell Incorporated, Shelton, CT (US)

(72) Inventors: John Hollander, East Dundee, IL (US); Chris Bailey, Greenville, SC (US); Brien Joseph Housand, Pensacola, FL (US); Eric Miller, Simpsonville, TX (US); David Rector, Mauldin, SC (US); Ryan Thompson, Somerville, MA (US); Michael Tinstman, Malden, MA (US); Nathaniel Stephen Hack DeVol, Greenville, SC (US); Stephen Andrew Kiff, Greenville, SC (US)

(73) Assignee: Hubbell Incorporated, Shelton, CT (US)

( * ) Notice: Subject to any disclaimer, the term of this patent is extended or adjusted under 35 U.S.C. 154(b) by 274 days.

(21) Appl. No.: 15/492,632

(22) Filed: Apr. 20, 2017

(65) Prior Publication Data

US 2017/0307145 A1 Oct. 26, 2017

Related U.S. Application Data

(60) Provisional application No. 62/325,095, filed on Apr. 20, 2016.

(51) Int. Cl.
*F21S 8/00* (2006.01)
*F21V 5/02* (2006.01)
(Continued)

(52) U.S. Cl.
CPC ..... *F21S 8/033* (2013.01); *F21V 5/02* (2013.01); *F21V 19/04* (2013.01); *F21V 23/04* (2013.01);
(Continued)

(58) Field of Classification Search
CPC . F21K 9/27; F21K 9/272; F21K 9/275; F21K 9/278; F21S 8/033; F21S 8/036;
(Continued)

(56) References Cited

U.S. PATENT DOCUMENTS 3,557,359 A * 1/1971 Meyer ..... F21V 33/0072 174/501
5,272,608 A * 12/1993 Engle ..... F21S 8/033 362/217.05
(Continued)

FOREIGN PATENT DOCUMENTS

AT 14831 U1 * 7/2016 ..... F21S 8/033
DE 202011050551 U1 * 11/2011 ..... F21K 9/27
WO WO-2013185432 A1 * 12/2013 ..... F21K 9/232

OTHER PUBLICATIONS

PCT International Preliminary Report on Patentability for corresponding PCT Application No. PCT/US2017/28539, dated Oct. 23, 2018—8 pages.
PCT International Search Report for corresponding PCT Application No. PCT/US2017/28539, dated Sep. 29, 2017—4 pages.

*Primary Examiner* — Alexander K Garlen
*Assistant Examiner* — Colin J Cattanach
(74) *Attorney, Agent, or Firm* — Michael Best & Friedrich, LLP

(57) ABSTRACT

Multi-function lighting fixtures are provided. In one example implementation, a lighting fixture may include an optical housing extending lengthwise between a first end and a second end. The optical housing may include a plurality of light sources disposed within an interior of the optical housing and a plurality of optical elements disposed along an exterior of the optical housing. The optical housing may also a plurality of compartments defined within the interior of the optical housing. Each of the optical compartments may be associated with a separate light source of the
(Continued)

plurality of light sources and a separate optical element of the plurality of optical elements.

20 Claims, 11 Drawing Sheets

(51) Int. Cl.

| | |
|---|---|
| ***F21V 19/04*** | (2006.01) |
| ***F21V 23/04*** | (2006.01) |
| ***F21Y 103/10*** | (2016.01) |
| ***F21Y 115/10*** | (2016.01) |
| ***F21Y 113/10*** | (2016.01) |
| ***F21V 5/04*** | (2006.01) |
| ***F21W 131/208*** | (2006.01) |
| ***F21Y 113/00*** | (2016.01) |
| ***F21V 23/02*** | (2006.01) |
| ***F21S 2/00*** | (2016.01) |
| ***F21V 15/01*** | (2006.01) |
| ***F21V 19/00*** | (2006.01) |

(52) U.S. Cl.
CPC ..... *F21S 2/005* (2013.01); *F21S 8/036* (2013.01); *F21V 5/04* (2013.01); *F21V 15/013* (2013.01); *F21V 19/0045* (2013.01); *F21V 23/023* (2013.01); *F21W 2131/208* (2013.01); *F21Y 2103/10* (2016.08); *F21Y 2113/00* (2013.01); *F21Y 2113/10* (2016.08); *F21Y 2115/10* (2016.08)

(58) Field of Classification Search
CPC ..... F21S 6/008; F21S 4/20; F21S 4/28; F21V 7/0016; F21V 19/0035; F21V 19/0045; E04F 11/00; F21W 2111/08; F21Y 2107/90
See application file for complete search history.

(56) References Cited

U.S. PATENT DOCUMENTS

| | | | | |
|---|---|---|---|---|
| 5,539,626 | A * | 7/1996 | Scholz | F21V 23/04 362/237 |
| 5,848,833 | A * | 12/1998 | Margulies | F21S 8/06 362/147 |
| 8,616,730 | B2 * | 12/2013 | Edwards, Jr. | H05B 33/0803 362/225 |
| 9,081,125 | B2 | 7/2015 | Dau et al. | |
| 2003/0179577 | A1 * | 9/2003 | Marsh | F21V 19/008 362/260 |
| 2003/0227772 | A1 * | 12/2003 | Yoshida | F21V 21/30 362/147 |
| 2006/0146531 | A1 | 7/2006 | Reo et al. | |
| 2009/0296381 | A1 * | 12/2009 | Dubord | F21S 2/005 362/218 |
| 2011/0038147 | A1 * | 2/2011 | Lin | F21V 19/004 362/235 |
| 2011/0156584 | A1 * | 6/2011 | Kim | F21K 9/00 315/32 |
| 2012/0229025 | A1 * | 9/2012 | Edwards, Jr. | H05B 33/0803 315/35 |
| 2013/0039051 | A1 * | 2/2013 | Wu | F21V 31/00 362/218 |
| 2013/0050908 | A1 * | 2/2013 | Zhang | F21V 23/026 361/674 |
| 2013/0058076 | A1 | 3/2013 | Ni | |
| 2013/0271971 | A1 * | 10/2013 | Uemura | F21V 3/02 362/223 |
| 2014/0126199 | A1 | 5/2014 | Heeter et al. | |
| 2015/0049475 | A1 * | 2/2015 | Pan | F21V 19/0045 362/218 |
| 2015/0091471 | A1 * | 4/2015 | Shan | B60Q 3/43 315/294 |
| 2015/0276169 | A1 * | 10/2015 | Bullard | F21V 5/04 362/235 |
| 2016/0369950 | A1 * | 12/2016 | Yeager | F21V 3/02 |
| 2017/0059094 | A1 * | 3/2017 | Wolffe | H05B 37/0245 |

* cited by examiner

MULTI-FUNCTION LIGHTING FIXTURE

PRIORITY CLAIM

The present application claims the benefit of priority of U.S. Provisional Application Ser. No. 62/325,095, titled "Multi-Function Lighting Fixture," filed on Apr. 20, 2016, which is incorporated herein by reference.

FIELD

The present subject matter relates generally to lighting fixtures.

BACKGROUND

Lighting fixtures are installed onto walls to provide for overall illumination of all or a portion of an adjacent room and/or to provide focused lighting to certain areas of the room. For example, in healthcare applications, a patient or bed lighting fixture is often mounted to the wall above a patient's bed to provide a focused source of light for ambient and reading illumination for the patient. However, functionality-wise, such conventional lighting fixtures are typically one-dimensional.

To address this issue, attempts have been made to create patient or bed lighting fixtures that are capable of contributing dedicated examination lighting. Unfortunately, such prior art attempts have failed to provide a completely desirable solution. For instance, multi-function lighting fixtures have been developed that require a user to physically pivot a portion of the fixture relative to another portion of the fixture to obtain the additional functionality. The manual interaction required for such lighting fixtures is often an undesirable feature for many end-users and may introduce risk for the patient and healthcare staff.

In recent years, lighting fixtures have been developed that are designed to project light in more than one direction without the need for a user to manually move a portion of the lighting fixture. However, the added functionality of such lighting fixtures is often limited. Moreover, these more recent lighting fixtures have been designed for use with incandescent or fluorescent light sources, which can lead to issues with efficiency, durability, maintenance and thermal management.

BRIEF DESCRIPTION

Aspects and advantages of embodiments of the present disclosure will be set forth in part in the following description, or may be learned from the description, or may be learned through practice of the embodiments.

In one example aspect, the present subject matter is directed to a multi-function lighting fixture. The lighting fixture may include an optical housing extending lengthwise between a first end and a second end. The optical housing may include a plurality of light sources disposed within an interior of the optical housing and a plurality of optical elements disposed along an exterior of the optical housing. The optical housing may also include a first optical compartment, a second optical compartment, and a third optical compartment defined within the interior of the optical housing. Each of the optical compartments may be associated with a separate light source of the plurality of light sources and a separate optical element of the plurality of optical elements. In addition, the lighting fixture may include a first mounting bracket coupled to the first end of the housing and a second mounting bracket coupled to the second end of the housing. The first and second mounting brackets may be configured to support the optical housing relative to a mounting surface of the multi-function lighting fixture such that an air gap is defined between the optical housing and the mounting surface.

In another example aspect, the present subject matter is directed to a multi-function lighting fixture. The lighting fixture includes an optical housing extending lengthwise between a first end and a second end. The optical housing can include a plurality of light sources disposed within an interior of the optical housing and a plurality of optical elements disposed along an exterior of the optical housing. The optical housing can include a first optical compartment, a second optical compartment, a third optical compartment, and a fourth optical compartment defined within the interior of the optical housing. Each of the optical compartments can be associated with a separate light source of the plurality of light sources and a separate optical element of the plurality of optical elements.

Other example aspects of the present subject matter are directed to systems, methods, apparatus, and/or other lighting fixtures configured according to one or more of the embodiments disclosed herein or variants thereof.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION OF THE INVENTION

Figure 1:
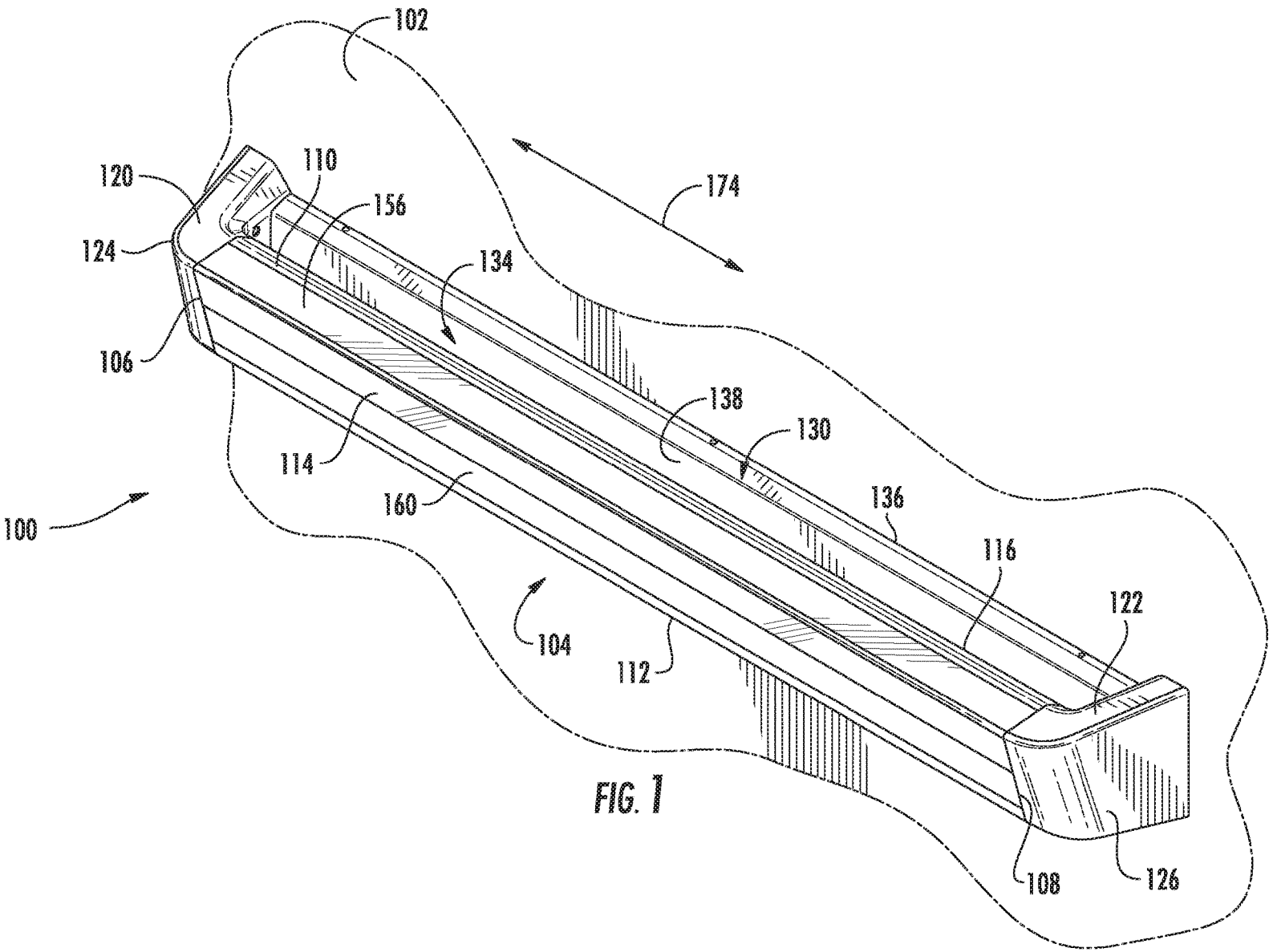
FIG. 1 illustrates a perspective view of a multi-function lighting fixture mounted to a wall or other suitable mounting surface according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a multi-function lighting fixture. In several embodiments, the disclosed lighting fixture may be used as a patient or bed lighting fixture for healthcare applications. For example, the lighting fixture may be mounted above a patient's bed to provide various lighting modes within the room. Specifically, in one embodiment, the lighting fixture may provide ambient lighting for the room and may also serve as both an examination light source and a reading light source. In addition, the lighting fixture may serve as a source of lighting, which may allow for the fixture to function as a night light or a color therapy solution.

In several embodiments, the disclosed lighting fixture may include an optical housing defining a plurality of separate optical compartments, with each optical compartment being associated with a separate light source and optical element for directing light from the housing. In such embodiments, each individual optical compartment may be configured to provide a different lighting mode for the lighting fixture. For instance, in one embodiment, the optical housing may include top and bottom optical compartments as well as front and rear optical compartments. In such an embodiment, the light source associated with the top optical compartment may be configured to direct light upwardly through the top side of the optical housing to provide ambient lighting for the room while the light source disposed within the bottom optical compartment may be configured to directly light downwardly through the bottom side of the optical housing to serve as a source of reading light. Similarly, the light source disposed within the front optical compartment may be configured to direct light outwardly from the front side of the housing to serve as a patient examination light while the light source disposed within the rear optical compartment may be configured to direct light outwardly from the rear side of the housing in the direction of the wall to serve as a night light or to provide any other type of low-level lighting (e.g., to provide color therapy).

In some embodiments, any combination of the compartments can be used simultaneously to provide desired lighting effects. For instance, the two or more compartments can be used in combination to enhance the light level, improve uniformity, or adjust the correlated color temperature of the lighting.

It should be appreciated that, although the present subject matter will generally be described herein with reference to the disclosed lighting fixture being utilized as a patient or bed light for healthcare applications, the fixture may also be utilized in any other setting or application in which it may be desirable to provide various different lighting modes within the room. It should also be appreciated that, although each optical compartment of the lighting fixture will be described herein as providing a specific lighting function (e.g., ambient light, examination light, reading light, or low-level light), the various optical compartments may be configured to provide any suitable lighting function.

As will be described below, the various light sources contained within the optical housing may, in several embodiments, form part of a light emitting diode (LED) lighting system. For example, each light source may include an array of LED devices configured to become illuminated as a result of the movement of electrons through a semiconductor material. As is generally understood, LED lighting systems can provide increased efficiency, life and durability, can produce less heat, and can provide other advantages relative to traditional incandescent and fluorescent lighting systems. Moreover, the efficiency of LED lighting systems has increased such that the same or similar light output can be provided at lower operational cost to the consumer in comparison to legacy light sources.

Additionally, in several embodiments, the lighting fixture may include mounting brackets coupled to the opposed ends of the optical housing to support the housing relative to the wall onto which the fixture is mounted. In accordance with aspects of the present subject matter, the mounting brackets may be configured to extend outwardly from the wall such that the optical housing is spaced apart from the wall by a given lateral distance. As such, an air gap may be defined between the optical housing the adjacent wall (or a wire way located on the adjacent wall).

Further, the lighting fixture may also include a secondary housing extending between the first and second mounting brackets. In several embodiments, the secondary housing may be spaced apart laterally from the optical housing (e.g., by placing the secondary housing directly adjacent to the wall) such that the air gap is defined between the optical housing and the secondary housing. In such embodiments, the air gap provided between the housings may provide enhanced thermal management as well as ease of service and installation for the lighting fixture. For example, one or more of the heat generating components of the lighting fixture, such as electrical conductors, power circuit, control device(s) and/or other components, may be housed within the secondary housing, thereby isolating such components from the optical housing.

Figure 2:
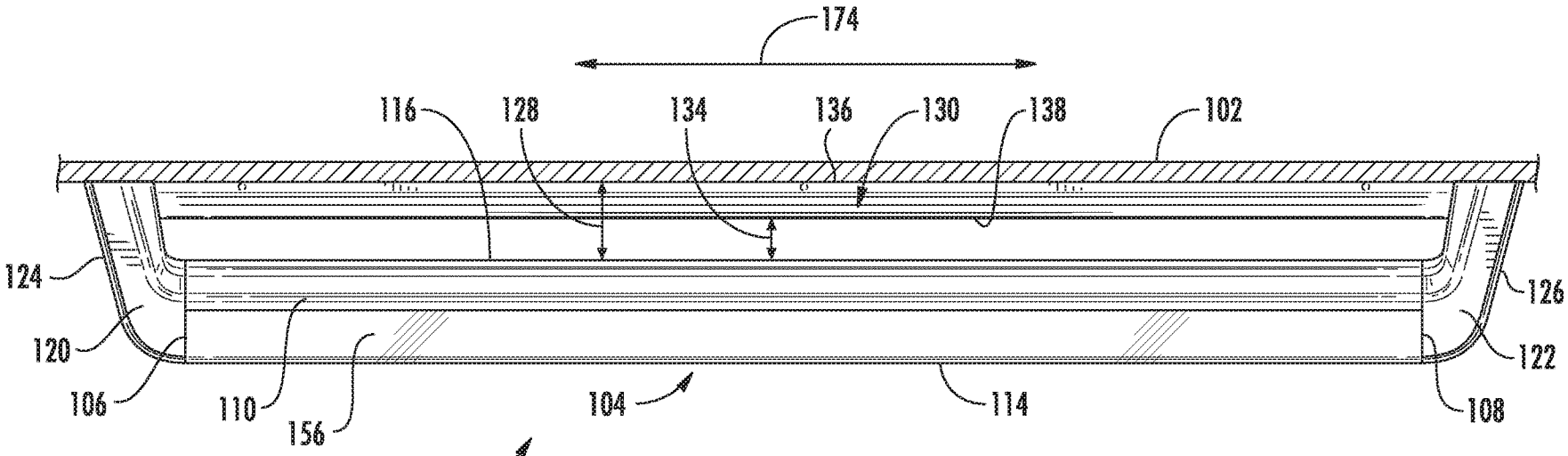
FIG. 2 illustrates a top view of the multi-function lighting fixture shown in FIG. 1.
Figure 3:
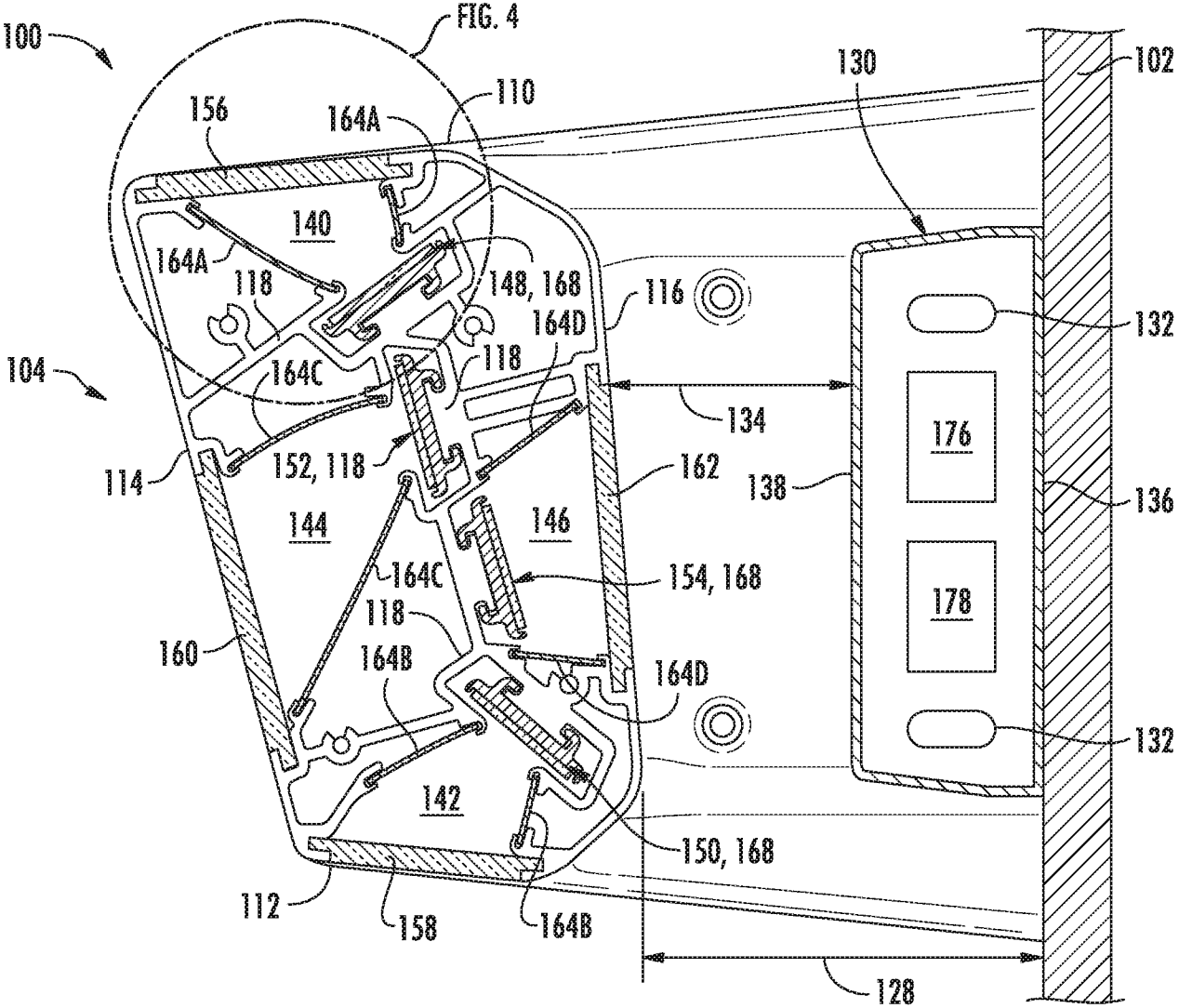
FIG. 3 illustrates a cross-sectional view of the multi-function lighting fixture shown in FIG. 2.

Referring now to FIGS. 1-3, several views of one embodiment of a multi-function lighting fixture 100 are illustrated in accordance with aspects of the present subject matter. Specifically, FIG. 1 illustrates a perspective view of the lighting fixture 100 mounted to an adjacent mounting surface 102 (e.g., a wall) and FIG. 2 illustrates a top view of the lighting fixture 100 shown in FIG. 1. Additionally, FIG. 3 illustrates a cross-sectional view of the lighting fixture 100 shown in FIG. 2.

As shown in FIGS. 1 and 2, the lighting fixture 100 may generally include an optical housing 104 extending lengthwise between a first end 106 and a second end 108. The housing 104 may also extend vertically between top and bottom sides 110, 112 and laterally between front and rear sides 114, 116. As will be described below, the optical housing 104 may contain a plurality of light sources (e.g., LED array) and may also define a plurality of optical compartments, with each optical compartment being associated with one of the light sources for directing light outwardly from the housing 104.

It should be appreciated that the housing 104 may generally be formed from any suitable material. However, in several embodiments, the housing 104 may be formed from a relatively lightweight material, such as aluminum or a suitable polymer material. It should also be appreciated that the housing 104 may include any suitable inner support structure 118 for supporting the various components located within the interior of the housing 104. For instance, as shown in FIG. 3, the inner support structure 118 may include a plurality of walls, flanges, hooks, retention features and/or any other suitable structure for assembling the internal components of the housing 104 in a manner consistent with the disclosure provided herein.

Additionally, as shown in FIGS. 1 and 2, the optical housing 104 may be configured to be mounted relative to a wall or other suitable mounting surface 102. Specifically, in several embodiments, a pair of mounting brackets 120, 122 may be secured to a back plate secured to a mounting surface to mount the optical housing 104 to the mounting surface 102. For instance, as shown in the illustrated embodiment, a first mounting bracket 120 may be coupled to the first end 106 of the optical housing 104 while a second mounting bracket 122 may be coupled to the second end 108 of the housing 104. In such an embodiment, the opposite ends or sides of the mounting brackets 120, 122 may, in turn, be coupled to a back plate to allow the optical housing 104 to be supported relative to a mounting surface. As shown in FIGS. 1 and 2, suitable end covers 124, 126 may be positioned over and/or adjacent to each mounting bracket 120, 122 at the ends 106, 108 of the optical housing 104 to conceal any associated mounting hardware and/or wiring of the lighting fixture 100. In one embodiment, the end covers 124, 126 may have a shape or profile that is complementary to the shape or profile of the optical housing 104 and/or the mounting brackets 120, 122 to provide a continuous or uniform aesthetic look to the lighting fixture 100 as it extends from the optical housing towards the mounting surface 102.

As particularly shown in FIGS. 2 and 3, the mounting brackets 120, 122 and corresponding end covers 124, 126 may generally be configured to extend outwardly from the mounting surface 102 and/or back plate (e.g., by extending generally perpendicularly from the surface 102) such that the optical housing 104 is spaced apart from the mounting surface 102 by a given lateral distance 128. For example, in several embodiments, the lateral distance 128 defined between the mounting surface 102 and the rear side 116 of the housing 104 may range from about 1 inch to about 6 inches, such as from about 2 inches to about 4 inches or from about 2.5 inches to about 3.5 inches and any other subranges therebetween. However, in other embodiments, the lateral distance 128 defined between the mounting surface 102 and the rear side 116 of the housing 104 may be less than one inch or greater than 6 inches.

Additionally, as shown in FIGS. 2 and 3, the lighting fixture 100 may also include a secondary housing 130 extending between the first and second mounting brackets 120, 122 for housing one or more components of the fixture 100. For example, the secondary housing 130 may serve as a wireway or conduit for any electrical wires 132 and/or other heat generating components of the lighting fixture 100. In several embodiments, the secondary housing 130 may be spaced apart laterally from the optical housing 104 such that an air gap 134 is defined between the housings 104, 130. For instance, as shown in FIGS. 2 and 3, the secondary housing 130 may extend laterally between a rear side 136 positioned directly adjacent to the mounting surface 102 and a front side 138 positioned opposite the rear side 136. In such an embodiment, the rear side 116 of the optical housing 104 may be spaced apart laterally from the front side 138 of the secondary housing 130 such that the air gap 134 is defined between the housings 104, 130.

It should be appreciated that the air gap 134 defined between the optical housing 104 and the secondary housing 130 may generally span across any suitable lateral distance. For instance, in one embodiment, the air gap 134 may extend a lateral distance ranging from 0.25 inches to about 4 inches, such as from about 0.5 inch to about 3 inches or from about 1 inch to about 2 inches and any other subranges therebetween.

It should also be appreciated that the air gap 134 may also provide numerous advantages to the disclosed lighting fixture 100. For example, the air gap 134 may reduce the visual mass of the fixture 100 and may also reduce the amount of horizontal surfaces that can potentially collect dust. In addition, by using the secondary housing 130 to house heat generating components, the air gap 134 may provide a means for separating such components from the optical housing 104, thereby facilitating improved thermal management. In addition, the servicing of the fixture 100 can be simplified by making certain electrical components/connections more accessible. In addition, installation can be facilitates by reducing the overall weight of the assembly to be supported while mounting the fixture 100 to a mounting surface.

Referring particularly now to FIG. 3, as indicated above, the optical housing 104 may define a plurality of optical compartments 140, 142, 144, 146, with each compartment being associated with a separate light source 148, 150, 152, 154 contained within the interior of the housing 104. For example, as shown in FIG. 3, the optical housing 104 defines four discrete optical compartments, namely a top optical compartment 140, a bottom optical compartment 142, a front optical compartment 144 and a rear optical compartment 146. Each optical compartment 140, 142, 144, 146 may generally correspond to an open cavity or space defined between one of the light sources 148, 150, 152, 154 and an associated optical element 156, 158, 160, 162 positioned along the exterior of the housing 104. For instance, the top optical compartment 140 may extend between a first light source 148 positioned within the interior of the optical housing 104 and a top optical element 156 extending along the top side 110 of the optical housing 104 while the bottom optical compartment 142 may extend between a second light source 150 positioned within the interior of the optical housing 104 and a bottom optical element 158 extending along the bottom side 112 of the optical housing 104. Similarly, the front optical compartment 144 may extend between a third light source 152 positioned within the interior of the optical housing 104 and a front optical element 160 extending along the front side 114 of the optical housing 104 while the rear optical compartment 146 may extend between a fourth light source 154 positioned within the interior of the optical housing 104 and a rear optical element 162 extending along the rear side 116 of the optical housing 104. In such an embodiment, each light source 148, 150, 152, 154 may be configured to project light through its associated optical compartment 140, 142, 144, 146 such that the light passes through the adjacent optical element 156, 158, 160, 162 and out of the optical housing 104.

Additionally, each optical compartment 140, 142, 144, 146 may include sidewalls 164 supported by the inner support structure 118 of the housing 104 that extends between its associated light source 148, 150, 152, 154 and optical element 156, 158, 160, 162. For instance, as shown in FIG. 3, the top optical compartment 140 may include one or more sidewalls 164A extending between the first light source 148 and the top optical element 156 while the bottom optical compartment 142 may include one or more sidewalls 164B extending between the second light source 150 and the bottom optical element 158. Similarly, the front optical compartment 144 may include one or more sidewalls 164C extending between the third light source 152 and the front optical element 160 while the rear optical compartment 146 may include one or more sidewalls 164D extending between the fourth light source 154 and the rear optical element 162. In several embodiments, each sidewall 164 may define a reflective surface 166 (FIG. 4) along its compartment side such that light from the associated light source 148, 150, 152, 154 is reflected off of the sidewall(s) 166 and is directed towards the corresponding optical element 156, 158, 160, 162. In addition, the sidewalls 164 may also be configured to serve as divider walls for optically isolating the light sources 148, 150, 152, 154 from one another and for separating each optical compartment 140, 142, 144, 146 from the remainder of the interior the optical housing 104. As such, each light source 148, 150, 152, 154 may include an isolated optical compartment 140, 142, 144, 146 and associated optical element 156, 158, 160, 162 for projecting light from the interior of the optical housing 104.

It should be appreciated that the light sources 148, 150, 152, 154 may generally correspond to or form part of any suitable lighting device or system. However, in several embodiments, each light source 148, 150, 152, 154 may correspond to one or more light emitting diode (LED) arrays 168. In such embodiments, the LED array(s) 168 forming each light source 148, 150, 152, 154 may include one or more LED devices 170 (FIG. 4) that are configured to emit light (e.g. visible light, ultraviolet light, infrared light, or other light or electromagnetic energy) as a result of movement of electrons through a semiconductor material. For instance, in one embodiment, each LED array 168 may include a plurality of LED devices 170 spaced apart along the length of a light board or tray 172 (FIG. 4), with the light tray 172 extending longitudinally along a lengthwise direction (indicated by arrow 174 in FIG. 1) of the optical housing 104 between its first and second ends 106, 108. In some embodiments, the trays 172 can be keyed so that their installation can be controlled so that the LED boards align properly for enhanced performance. As will be described below, such LED arrays 168 may be removed from and/or installed within the optical housing 104 at one or both of its ends 106, 108 by removing the end cover(s) 124, 126 (and other related components) and by sliding the light trays 172 relative to the housing 104 along its lengthwise direction 174.

Additionally, it should be appreciated that each optical element 156, 158, 160, 162 may generally correspond to any suitable element or component for allowing light from its corresponding light source 148, 150, 152, 154 to pass therethrough. In several embodiments, the optical elements 156, 158, 160, 162 may correspond to optical lenses. In such embodiments, the lenses may correspond to any suitable lenses known in the art. For example, in one embodiment, one or more of the optical elements 156, 158, 160, 162 may correspond to a linear prism lens and/or any other suitable lens typically utilized with LED-based light sources. The lenses can be keyed so that their installation can be facilitated to align properly with the LED boards.

The lighting fixture 100 may also include a power circuit 176 configured to receive an input power from a power source (e.g., an AC or DC power source) and convert the input power to an output power suitable for powering the light sources 148, 150, 152, 154. Specifically, in several embodiments, the power circuit 176 may be configured to provide different driving currents to each of the light sources 148, 150, 152, 154. For instance, the power circuit 176 may include one or more of a multi-channel driver circuit, a current splitter circuit, one or more current regulators, and/or other devices that can be used to independently provide a driver current to each of the light sources 148, 150, 152, 154.

Additionally, in one embodiment, the lighting fixture 100 may also include a means for controlling the power distribution to each of the light sources 148, 150, 152, 154. For instance, the lighting fixture 100 may include one or more control device(s) 178. The control device(s) 178 may include, for instance, one or more processors, microcontrollers, microprocessors, logic circuits, application specific integrated circuits, etc., and may be configured to transmit control signals to the power circuit 176 for adjusting the power distribution (e.g., the driving current) to the light sources 148, 150, 152, 154, which may allow for the control device(s) 178 to control the intensity, color temperature and/or any other parameter of the light output by each light source 148, 150, 152, 154.

As shown in FIG. 3, in one embodiment, the power circuit 176 and control device(s) 178 may be housed within the secondary housing 130 of the lighting fixture 100. However, in other embodiments, the power circuit 176 and/or control device(s) 178 may be located at any other suitable location within and/or relative to the lighting fixture 100.

As indicated above, the specific placement of the isolated optical compartments 140, 142, 144, 146 and associated light sources 148, 150, 152, 154 and optical elements 156, 158, 160, 162 around and/or relative to the optical housing 104 may allow the disclosed lighting fixture 100 to provide various different light modes. For instance, light generated by the first light source 148 may be directed upwards through the top optical element 156 located along the top side 110 of the optical housing 104 to provide ambient lighting for the adjacent room while light generated by the second light source 150 may be directed downward through the bottom optical element 158 located along the bottom side 112 of the optical housing 104 to serve as a source of reading light (e.g., for a patient located in a bed extending outwardly from the wall on which the lighting fixture 100 is mounted). Similarly, light generated by the third light source 152 may be directed outwardly through the front optical element 160 located along the front side 114 of the optical housing 104 towards the interior of the adjacent room to serve as a source of examination lighting while light generated by the fourth light source 154 may be directed outwardly through the rear optical element 162 located along the rear side 116 of the optical housing 104 towards the adjacent wall to serve as a source of low-level lighting.

It should be appreciated that, in alternative embodiments, the optical housing 104 need not include all four of the above-described optical compartments 140, 142, 144, 146 and associated light sources 148, 150, 152, 154 and optical elements 156, 158, 160, 162. For instance, in one embodiment, the rear optical compartment 146 may be removed such that the optical housing 104 only includes the top, bottom, and front optical compartments 140, 142, 144. In another embodiment, the front optical compartment 144 may be removed such that the optical housing 104 only includes the top, bottom, and rear optical compartments 140, 142, 146.

Additionally, as indicated above, it should be appreciated that the various light sources 148, 150, 152, 154 may be controlled independently to provide the desired functionality for the disclosed lighting fixture 100. For instance, each light source 148, 150, 152, 154 may be independently activated or deactivated to allow the light source to be turned on/off in isolation or in combination with any of the other lights sources. Similarly, the power distribution to each light source 148, 150, 152, 154 may be independently controlled so as to provide the desired light output based on the intended function of the light source. For instance, in embodiments in which the first and second light sources 148, 150 serve as sources of ambient and reading light, respectively, and the third light source 152 serves as an examination light, the driving current supplied to such light sources 148, 150, 152 may differ to adjust the intensity of the light output of each light source. For instance, the driving current supplied to the third light source 152 may be controlled such that the third light source 152 provides a higher light intensity (e.g., an intensity of greater than about 100 foot-candles (fc)) than the light intensity provided by the first light source 148 (e.g., an intensity of less than about 20 fc) and the second light source 150 (e.g., an intensity ranging from about 10 fc to about 50 fc).

Similarly, in embodiments in which the fourth light source 154 is being used for light therapy, the operation of such light source 154 may be controlled so as to provide the desired color and/or time-variant color pattern. For instance, in one embodiment, the fourth light source 154 may include different colored LED devices and/or LED devices associated with different color temperatures spaced apart along the length of the light tray 172. In such an embodiment, the operation of the fourth light source 154 may be controlled such that the different LED devices 174 are selectively activated and/or deactivated to provide the desired color output. In such an embodiment, the operation of the fourth light source 154 may be controlled to provide the desired color and/or color temperature output.

It should be appreciated that the disclosed lighting fixture 100 may incorporate or be associated with any other suitable components and/or features. For example, the lighting fixture 100 may incorporate a pull-chain (not shown) to provide an efficient means for switching the lighting fixture 100 between its differing lighting modes. In addition, for health-care applications, the lighting fixture 100 may include a bed stop switch lever arm (not shown) that is connected to the outlet into which the patient's bed is plugged to provide a safety feature for shutting off the functionality of the bed in the event that an object is being pushed against the lighting fixture 100 as the bed position/orientation is being adjusted.

Figure 4:
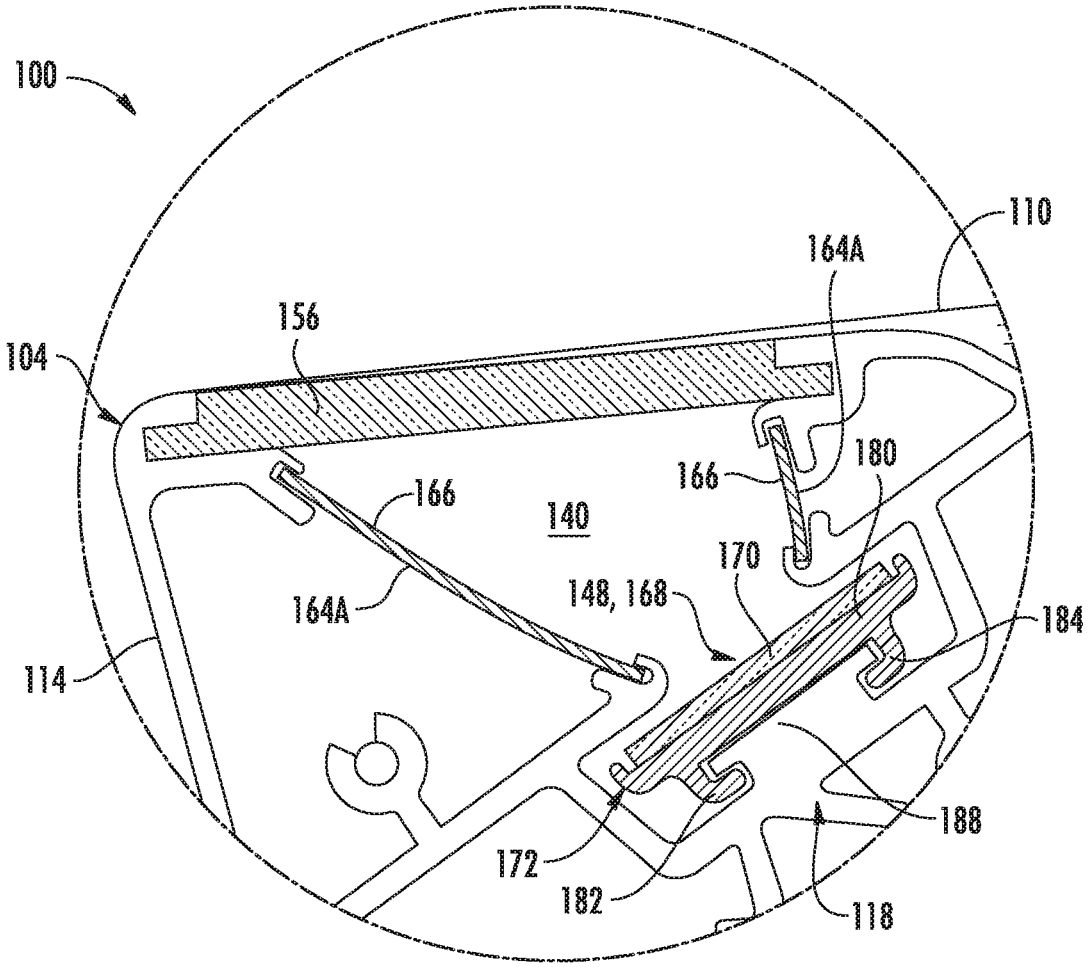
FIG. 4 illustrates a close-up view of a portion of the cross-sectional view of the multi-functional lighting fixture shown in FIG. 3.

Referring now to FIG. 4, a close-up view of a portion of the optical housing 104 shown in FIG. 3 is illustrated in accordance with aspects of the present subject, particularly illustrating the first light source 148, the top optical compartment 140, and the top optical element 156. As indicated above, in several embodiments, each light source 148, 150, 152, 154 may include a plurality of LED devices 170 arranged or otherwise supported on a light tray 172. As shown in FIG. 4, in one embodiment, each light tray 172 may include a retention feature configured to mate with a corresponding retention feature formed by a portion of the inner structure 118 of the optical housing 104. For example, in the illustrated embodiment, the light tray 172 includes a planar tray portion 180 and first and second flange hooks 182, 184 extending outwardly from the tray portion 180 such that a "T-shaped" channel 186 (FIG. 6) is defined between the flange hooks 182, 184. In such an embodiment, the inner structure 118 of the optical housing 104 may include or define a corresponding "T-shaped" projection 188 configured to be received within the channel 186. As such, the engagement of the flange hooks 182, 184 with the projection 188 may serve to retain the light source 148 relative to the remainder of the optical housing 104.

It should be appreciated that, in other embodiments, the flange hooks 182, 184 may be formed on the inner structure 118 of the optical housing 104 while the projection 188 may extend outwardly from the tray portion 180 of the light tray 172. Similarly, it should be appreciated that the mating retention features (e.g., the hooks/projection 182, 184, 188) may have any other suitable shape that allows the light tray 172 to be engaged with a portion of the inner structure 118 of the optical housing 104.

Figure 5:
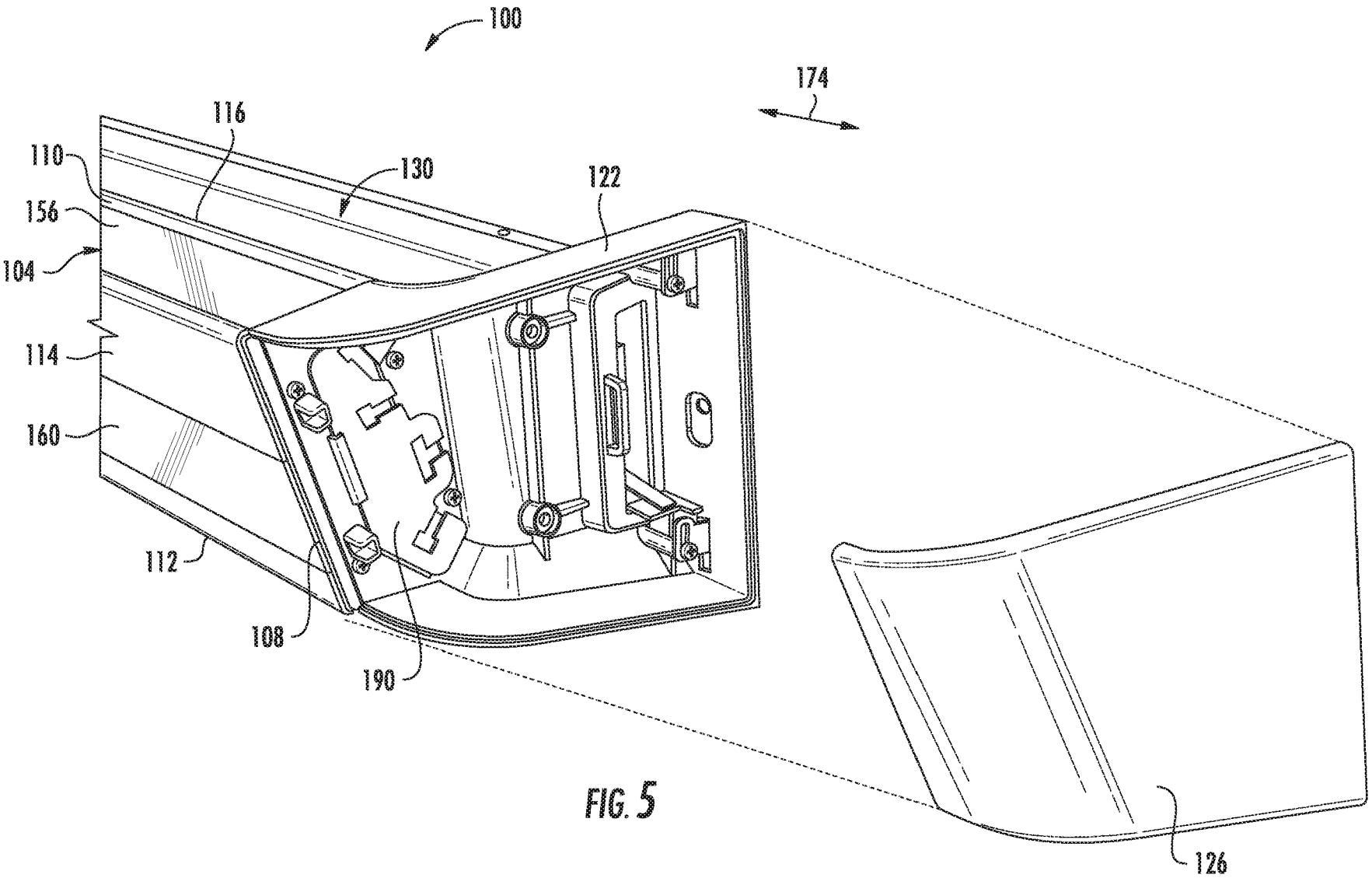
FIG. 5 illustrates a perspective, end view of a portion of the multi-function lighting fixture shown in FIG. 1, particularly illustrating an end cover of the lighting fixture being exploded away from an end of an optical housing of the lighting fixture.
Figure 6:
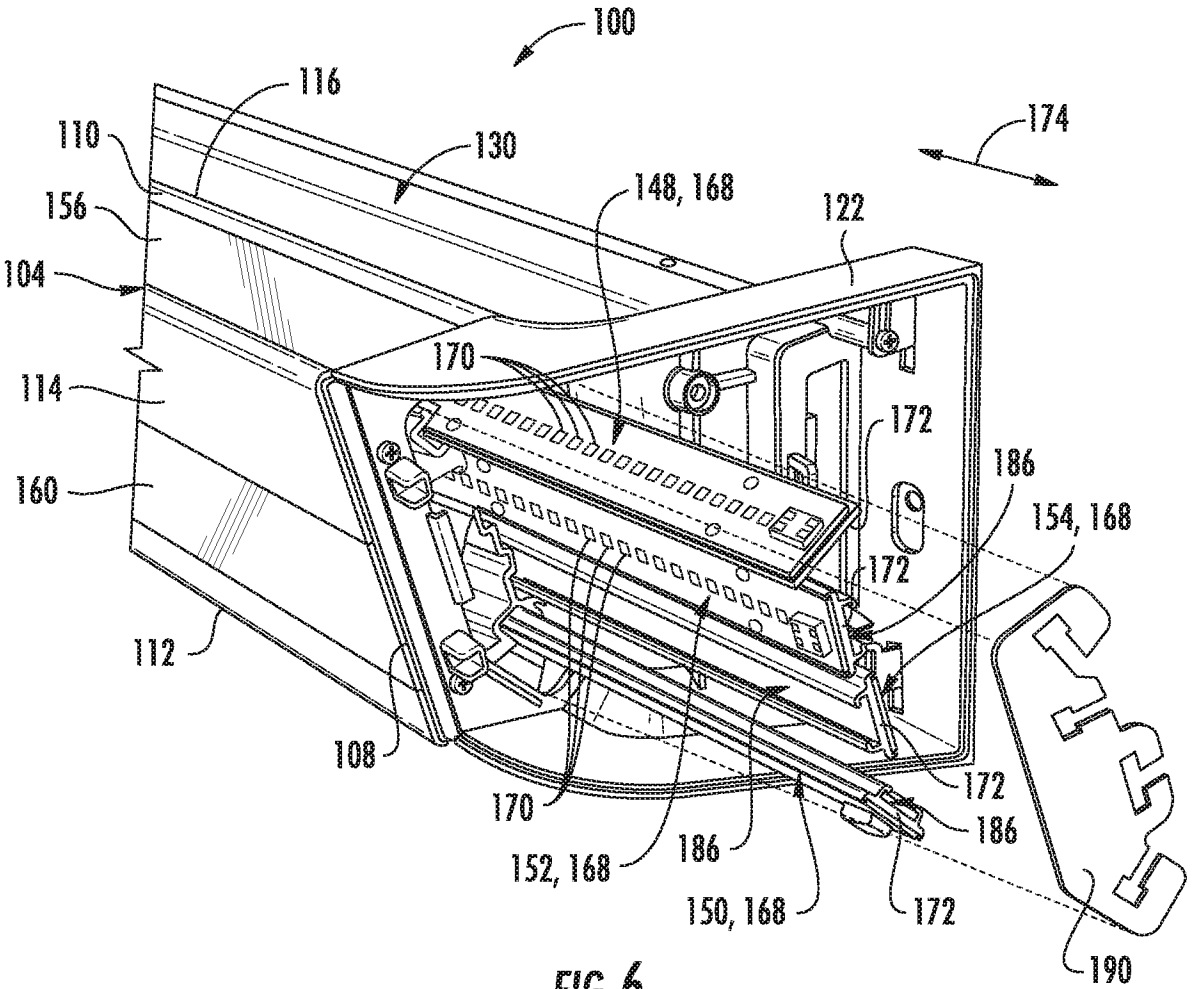
FIG. 6 illustrates a perspective, end view of the multi-function lighting fixture similar to that shown in FIG. 5, particularly illustrating a cover plate being exploded away from the end of the optical housing to provide access to one or more light sources disposed within the optical housing.

Additionally, by providing the same or similar mating retention features as that shown in FIG. 4, the light sources 148, 150, 152, 154 may be configured to be installed within and/or removed from the optical housing 104 by sliding the light trays 172 relative to the inner structure 118 of the optical housing 104 along its lengthwise direction 174. For instance, FIGS. 5 and 6 illustrate views showing a process for removing the light sources 148, 150, 152, 154 from the optical housing 104. Specifically, as shown in FIG. 5, one of the end covers (e.g., the second end cover 126) may be removed from the adjacent mounting bracket 122 to provide access to a cover plate 190 installed relative to the support bracket 122. For example, the lighting fixture 100 may include a cover plate 190 positioned at each end 106, 108 of the optical housing 104 to provide an end cap for the optical compartments 140, 142, 144, 146. Thereafter, as shown in FIG. 6, the cover plate 190 may be removed to provide access to each light source 148, 150, 152, 154, which may then be slid outwardly relative to the optical housing 104 to facilitate its removal from the housing 104.

A similar process may be utilized to install the light sources 148, 150, 152, 154 within the optical housing 104. For example, with the end cover 126 and cover plate 190 removed, the end of each light source 148, 150, 152, 154 may be positioned relative to its corresponding optical compartment 140, 142, 144, 146 such that the retention features of the light source 148, 150, 152, 154 (e.g., the flange hooks 182, 184) are aligned within the corresponding retention features of the optical housing 104 (e.g., the projection 188). Each light source 148, 150, 152, 154 may then be slid relative to the optical housing 104 in the lengthwise direction 174 until the light source 148, 150, 152, 154 is fully installed within the housing 104. Thereafter, the cover plate 190 may be reinstalled relative to the optical housing 104, followed by installation of the end cover 126 relative to the adjacent mounting bracket 122.

Figure 7:
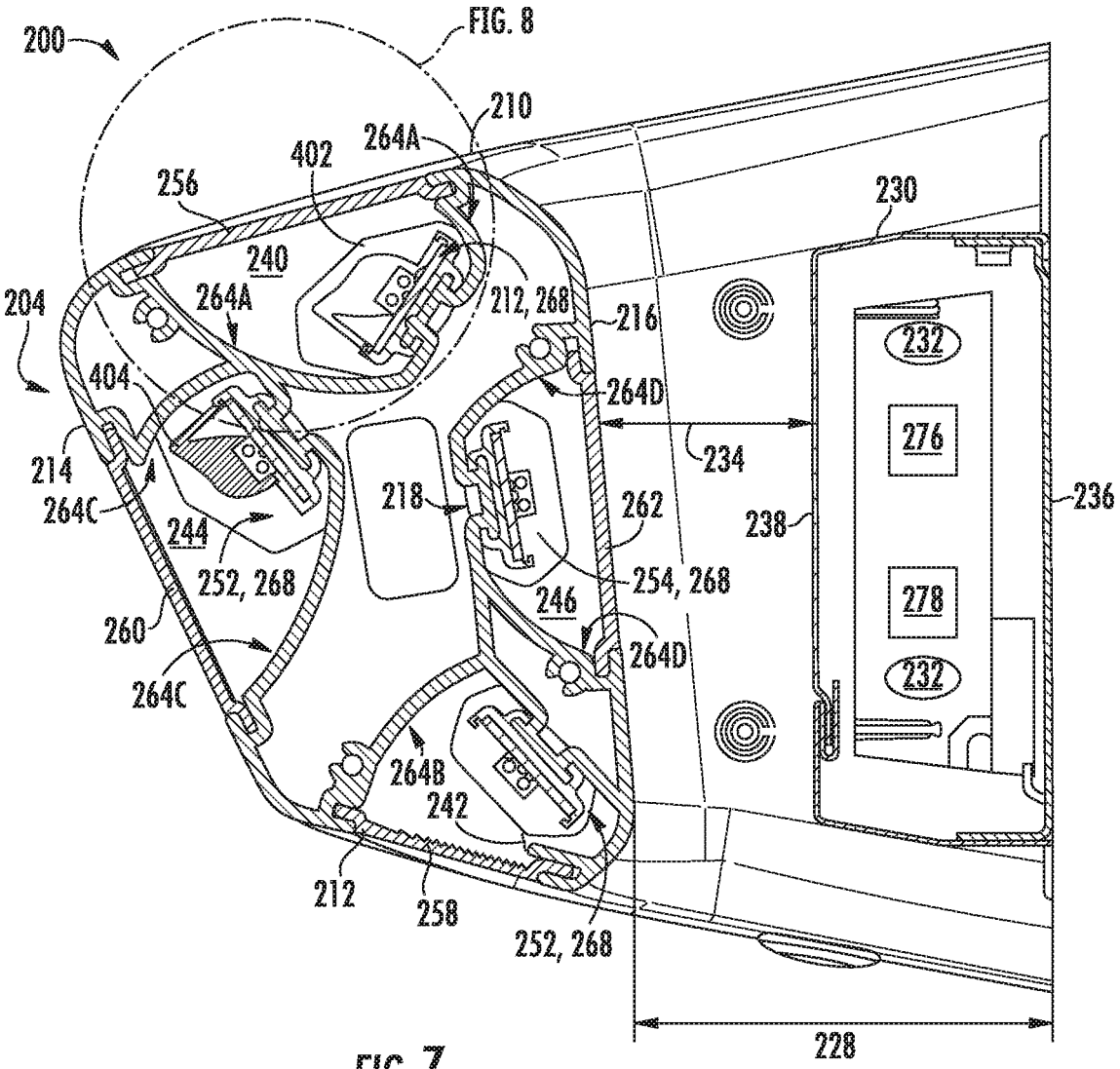
FIG. 7 illustrates a cross-sectional view of another embodiment of a multi-function lighting fixture.
Figure 8:
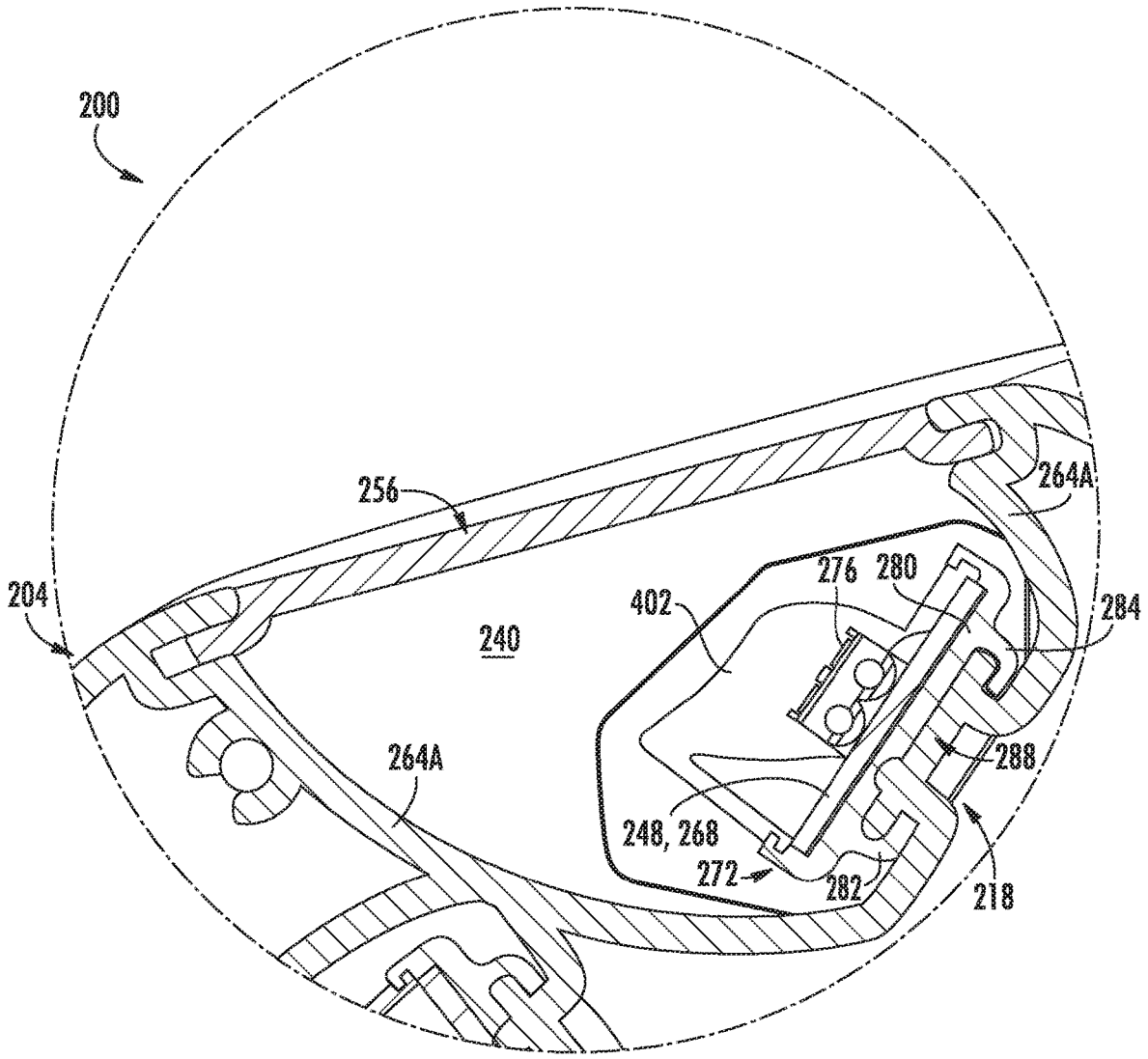
FIG. 8 illustrates a close-up view of a portion of the cross-sectional view of the multi-functional lighting fixture shown in FIG. 7.
Figure 9:
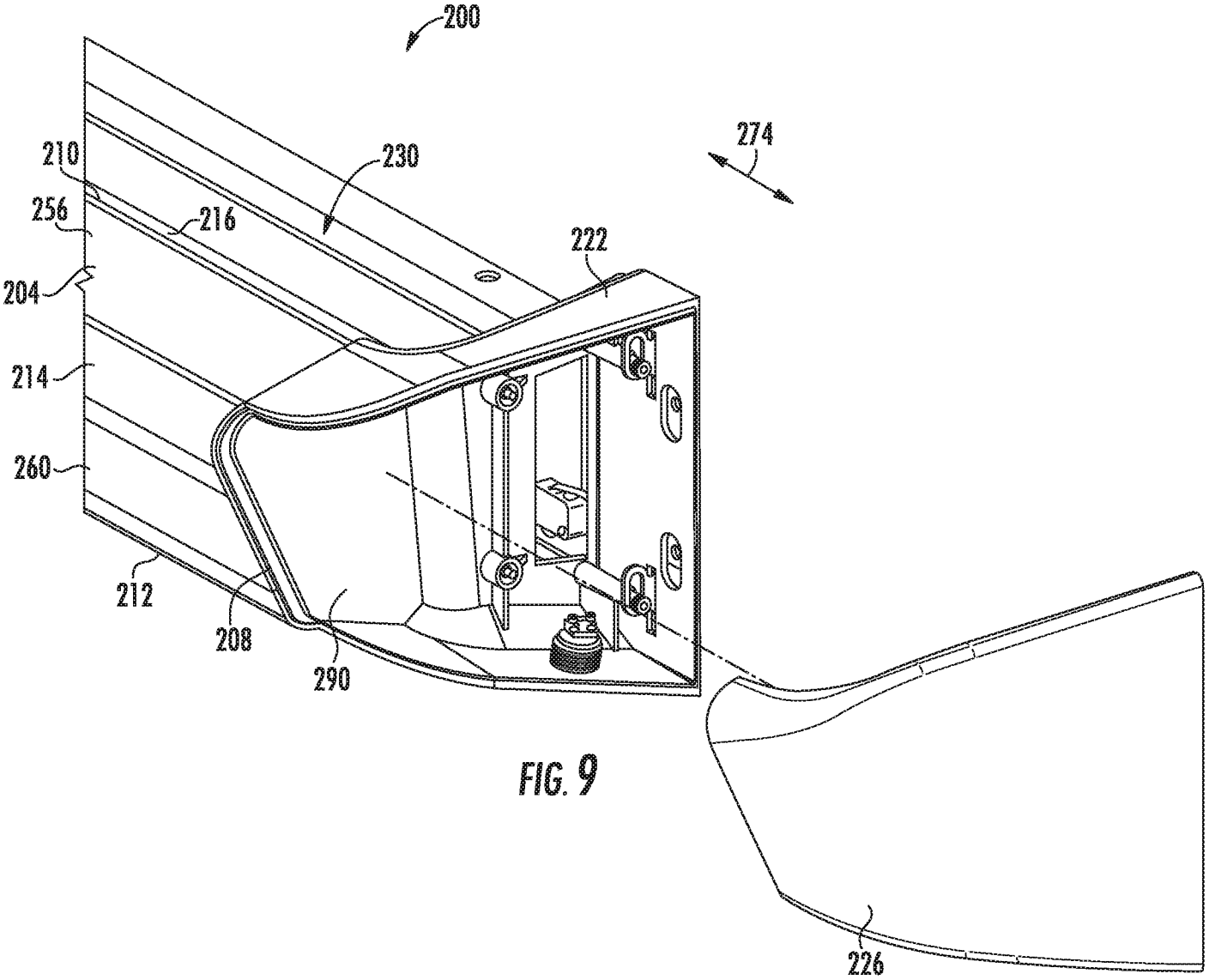
FIG. 9 illustrates a perspective, end view of a portion of the multi-function lighting fixture shown in FIG. 7, particularly illustrating an end cover of the lighting fixture being exploded away from an end of an optical housing of the lighting fixture.
Figure 10:
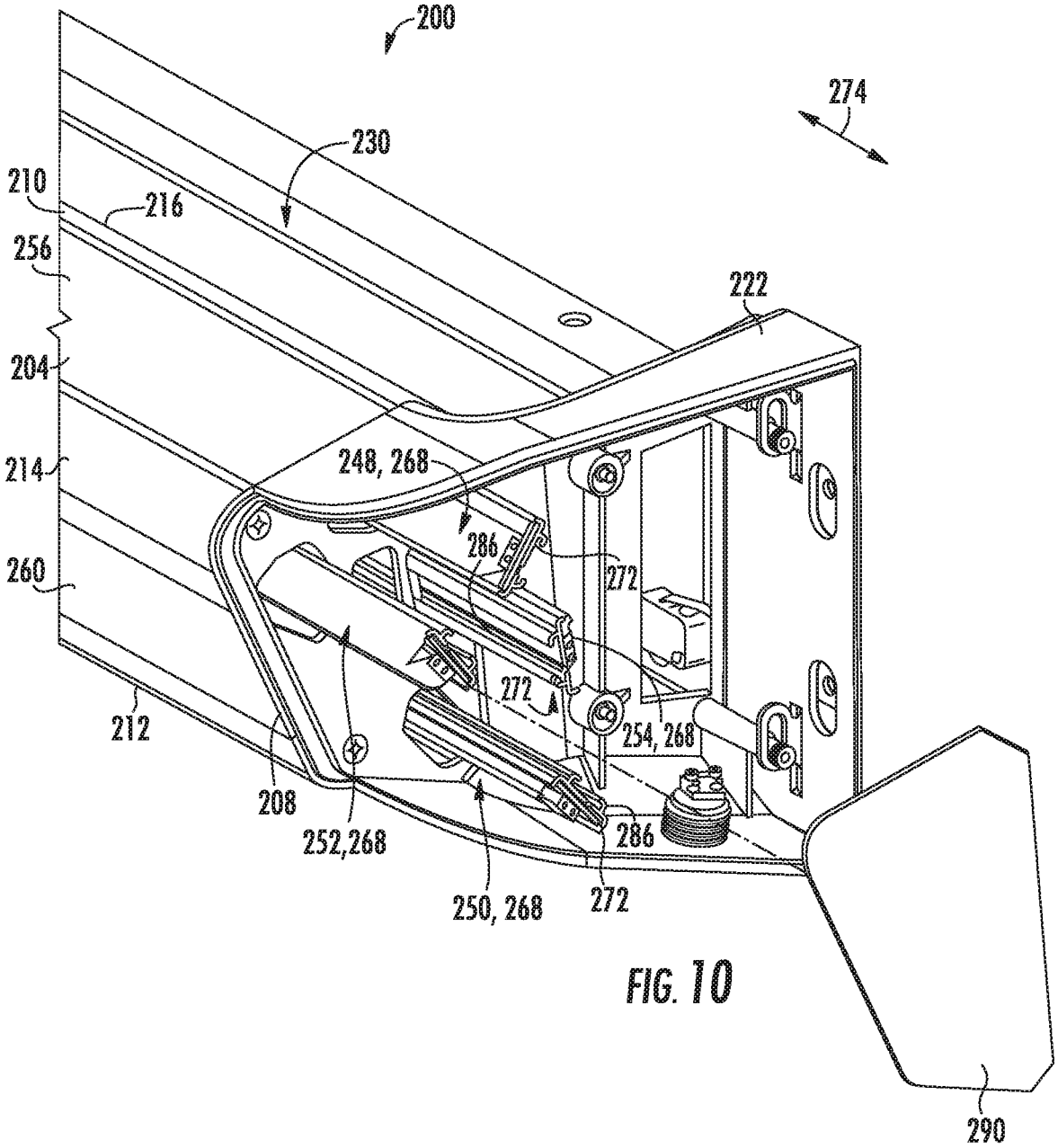
FIG. 10 illustrates a perspective, end view of the multi-function lighting fixture similar to that shown in FIG. 9, particularly illustrating a cover plate being exploded away from the end of the optical housing to provide access to one or more light sources disposed within the optical housing.

Referring now to FIGS. 7-10, several views of another embodiment of a multi-function lighting fixture 200 are illustrated in accordance with aspects of the present subject matter. Specifically, FIG. 7 illustrates a cross-sectional view of the lighting fixture 200, FIG. 8 illustrates a detail view of a portion of FIG. 7, and FIGS. 9-10 illustrate a detail view of an end cap according to the another embodiment of a multi-function lighting fixture 200.

As shown in FIGS. 7-10, the lighting fixture 200 may generally include an optical housing 204 extending lengthwise between a first end (not pictured) and a second end 208. The housing 204 may also extend vertically between top and bottom sides 210, 212 and laterally between front and rear sides 214, 216. As will be described below, the optical housing 204 may contain a plurality of light sources (e.g., LED array) and may also define a plurality of optical compartments, with each optical compartment being associated with one of the light sources for directing light outwardly from the housing 204.

It should be appreciated that the housing 204 may generally be formed from any suitable material. However, in several embodiments, the housing 204 may be formed from a relatively lightweight material, such as aluminum or a suitable polymer material. It should also be appreciated that the housing 204 may include any suitable inner support structure 218 for supporting the various components located within the interior of the housing 204. For instance, as shown in FIG. 7, the inner support structure 218 may include a plurality of walls, flanges, hooks, retention features and/or any other suitable structure for assembling the internal components of the housing 204 in a manner consistent with the disclosure provided herein.

Additionally, as shown in FIGS. 9-10, the optical housing 204 may be configured to be mounted relative to a wall or other suitable mounting surface. Specifically, in several embodiments, a pair of mounting brackets may be used to mount the optical housing 204 to the mounting surface. This is illustrated for one end 208 in FIGS. 9-10, wherein it is to be understood that the opposite end can be mounted in a substantially similar manner. As shown in FIGS. 9-10, a suitable end cover 226 may be positioned over and/or adjacent to each mounting bracket 222 at the ends 208 of the optical housing 204 to conceal any associated mounting hardware and/or wiring of the lighting fixture 200. In one embodiment, the end cover 226 may have a shape or profile that is complementary to the shape or profile of the optical housing 204 and/or the mounting bracket 222 to provide a continuous or uniform aesthetic look to the lighting fixture 200 as it extends from the optical housing towards the mounting surface.

As particularly shown in FIG. 7, the mounting bracket 222 and corresponding end cover 226 may generally be configured to extend outwardly from the mounting surface (e.g., by extending generally perpendicularly from the surface) such that the optical housing 204 is spaced apart from the mounting surface by a given lateral distance 228. For example, in several embodiments, the lateral distance 228 defined between the mounting surface and the rear side 216 of the housing 204 may range from about 1 inch to about 6 inches, such as from about 2 inches to about 4 inches or from about 2.5 inches to about 3.5 inches and any other subranges therebetween. However, in other embodiments, the lateral distance 228 defined between the mounting surface and the rear side 216 of the housing 204 may be less than one inch or greater than 6 inches.

Additionally, as shown in FIG. 7, the lighting fixture 200 may also include a secondary housing 230 extending between the mounting brackets for housing one or more components of the fixture 200. For example, the secondary housing 230 may serve as a wire way or conduit for any electrical wires 232 and/or other heat generating components of the lighting fixture 200. In several embodiments, the secondary housing 230 may be spaced apart laterally from the optical housing 204 such that an air gap 234 is defined between the housings 204, 230. For instance, as shown in FIG. 7, the secondary housing 230 may extend laterally between a rear side 236 positioned directly adjacent to the mounting surface and a front side 238 positioned opposite the rear side 236. In such an embodiment, the rear side 216 of the optical housing 204 may be spaced apart laterally from the front side 238 of the secondary housing 230 such that the air gap 234 is defined between the housings 204, 230.

It should be appreciated that the air gap 234 defined between the optical housing 204 and the secondary housing 230 may generally span across any suitable lateral distance. For instance, in one embodiment, the air gap 234 may extend a lateral distance ranging from 0.25 inches to about 4 inches, such as from about 0.5 inch to about 3 inches or from about 1 inch to about 2 inches and any other subranges therebetween.

It should also be appreciated that the air gap 234 may also provide numerous advantages to the disclosed lighting fixture 200. For example, the air gap 234 may reduce the visual mass of the fixture 200 and may also reduce the amount of horizontal surfaces that can potentially collect dust. In addition, by using the secondary housing 230 to house heat generating components, the air gap 234 may provide a means for separating such components from the optical housing 204, thereby facilitating improved thermal management.

Referring particularly now to FIG. 7, as indicated above, the optical housing 204 may define a plurality of optical compartments 240, 242, 244, 246, with each compartment being associated with a separate light source 248, 250, 252, 254 contained within the interior of the housing 204. For example, as shown in FIG. 7, the optical housing 204 defines four discrete optical compartments, namely a top optical compartment 240, a bottom optical compartment 242, a front optical compartment 244 and a rear optical compartment 246. Each optical compartment 240, 242, 244, 246 may generally correspond to an open cavity or space defined between one of the light sources 248, 250, 252, 254 and an associated optical element 256, 258, 260, 262 positioned along the exterior of the housing 204.

For instance, a top optical compartment 240 may extend between a first light source 248 positioned within the interior of the optical housing 204 and a top optical element 256 extending along the top side 210 of the optical housing 204. A molded optic 402 can be included with the light source 248. The first optical compartment 240 can be configured to provide ambient light for a space. The optical elements associated with the top optical compartment 244 can be configured to provide a forward throw distribution of light. The optical element 256 can be a diffuser optical element.

A front optical compartment 244 may extend between a light source 252 positioned within the interior of the optical housing 204 and a front optical element 260 extending along the front side 214 of the optical housing 204. A molded optic 404 can be used in conjunction with the light source 252. The front optical compartment 244 can be configured to provide examination light for a patient bed. The optical elements associated with the front optical compartment 244 can be configured to provide a uniform distribution of light across a patient bed. The front optical element 260 can be, for instance, a linear prism optical element.

The bottom optical compartment 242 may extend between a second light source 250 positioned within the interior of the optical housing 204 and a bottom optical element 258 extending along the bottom side 212 of the optical housing 204. The bottom optical compartment can be configured to provide reading light. The bottom optical element 258 can be, for instance, a window lens optical element.

The rear optical compartment 246 may extend between a fourth light source 254 positioned within the interior of the optical housing 204 and a rear optical element 262 extending along the rear side 216 of the optical housing 204. The rear optical compartment 246 can be configured to provide back light. The rear optical element 262 can be a diffuser optical element.

Additionally, each optical compartment 240, 242, 244, 246 may include sidewalls 264 supported by the inner support structure 218 of the housing 204 that extends between its associated light source 248, 250, 252, 254 and optical element 256, 258, 260, 262. For instance, as shown in FIG. 7, the top optical compartment 240 may include one or more sidewalls 264A extending between the first light source 248 and the top optical element 256 while the bottom optical compartment 242 may include one or more sidewalls 264B extending between the second light source 250 and the bottom optical element 258. Similarly, the front optical compartment 244 may include one or more sidewalls 264C extending between the third light source 252 and the front optical element 260 while the rear optical compartment 246 may include one or more sidewalls 264D extending between the fourth light source 254 and the rear optical element 262. In several embodiments, each sidewall 264 may comprise a reflective surface along its compartment side such that light from the associated light source 248, 250, 252, 254 is reflected off of the sidewall(s) 264 and is directed towards the corresponding optical element 256, 258, 260, 262. In addition, the sidewalls 264 may also be configured to serve as divider walls for optically isolating the light sources 248, 250, 252, 254 from one another and for separating each optical compartment 240, 242, 244, 246 from the remainder of the interior the optical housing 104. As such, each light source 248, 250, 252, 254 may include an isolated optical compartment 240, 242, 244, 246 and associated optical element 256, 258, 260, 262 for projecting light from the interior of the optical housing 204.

It should be appreciated that the light sources 248, 250, 252, 254 may generally correspond to or form part of any suitable lighting device or system. However, in several embodiments, each light source 248, 250, 252, 254 may correspond to one or more light emitting diode (LED) arrays 268. In such embodiments, the LED array(s) 268 forming each light source 248, 250, 252, 254 may include one or more LED devices 270 (FIG. 8) that are configured to emit light (e.g. visible light, ultraviolet light, infrared light, or other light or electromagnetic energy) as a result of movement of electrons through a semiconductor material. For instance, in one embodiment, each LED array 268 may include a plurality of LED devices 270 mounted to a light board or tray 272 (FIG. 8), with the light tray 272 extending longitudinally along a lengthwise direction (indicated by arrow 274 in FIGS. 9-10) of the optical housing 204 between its ends. As will be described below, such LED arrays 268 may be removed from and/or installed within the optical housing 204 at one or both of its ends by removing the end cover(s) 226 (and other related components) and by sliding the light trays 272 relative to the housing 204 along its lengthwise direction 274.

Additionally, it should be appreciated that each optical element 256, 258, 260, 262 may generally correspond to any suitable element or component for allowing light from its corresponding light source 248, 250, 252, 254 to pass therethrough. In several embodiments, the optical elements 256, 258, 260, 262 may correspond to optical lenses. In such embodiments, the lenses may correspond to any suitable lenses known in the art. For example, in one embodiment, each optical element 256, 258, 260, 262 may correspond to a linear prism lens and/or any other suitable lens typically utilized with LED-based light sources.

The lighting fixture 200 may also include a power circuit 276 configured to receive an input power from a power source (e.g., an AC or DC power source) and convert the input power to an output power suitable for powering the light sources 248, 250, 252, 254. Specifically, in several embodiments, the power circuit 276 may be configured to provide different driving currents to each of the light sources 248, 250, 252, 254. For instance, the power circuit 276 may include one or more of a multi-channel driver circuit, a current splitter circuit, one or more current regulators, and/or other devices that can be used to independently provide a driver current to each of the light sources 248, 250, 252, 254.

Additionally, in one embodiment, the lighting fixture 200 may also include a means for controlling the power distribution to each of the light sources 248, 250, 252, 254. For instance, the lighting fixture 200 may include one or more control device(s) 278. The control device(s) 278 may include, for instance, one or more processors, microcontrollers, microprocessors, logic circuits, application specific integrated circuits, etc., and may be configured to transmit control signals to the power circuit 276 for adjusting the power distribution (e.g., the driving current) to the light sources 248, 250, 252, 254, which may allow for the control device(s) 278 to control the intensity, color temperature and/or any other parameter of the light output by each light source 248, 250, 252, 254.

As shown in FIG. 7, in one embodiment, the power circuit 276 and control device(s) 278 may be housed within the secondary housing 230 of the lighting fixture 200. However, in other embodiments, the power circuit 276 and/or control device(s) 278 may be located at any other suitable location within and/or relative to the lighting fixture 200.

As indicated above, the specific placement of the isolated optical compartments 240, 242, 244, 246 and associated light sources 248, 250, 252, 254 and optical elements 256, 258, 260, 262 around and/or relative to the optical housing 204 may allow the disclosed lighting fixture 200 to provide various different light modes. For instance, light generated by the first light source 248 may be directed upwards through the top optical element 256 located along the top side 210 of the optical housing 204 to provide ambient lighting for the adjacent room while light generated by the second light source 250 may be directed downward through the bottom optical element 258 located along the bottom side 212 of the optical housing 204 to serve as a source of reading light (e.g., for a patient located in a bed extending outwardly from the wall on which the lighting fixture 200 is mounted). Similarly, light generated by the third light source 252 may be directed outwardly through the front optical element 260 located along the front side 214 of the optical housing 204 towards the interior of the adjacent room to serve as a source of examination lighting while light generated by the fourth light source 254 may be directed outwardly through the rear optical element 262 located along the rear side 216 of the optical housing 204 towards the adjacent wall to serve as a source of low-level lighting.

It should be appreciated that, in alternative embodiments, the optical housing 204 need not include all four of the above-described optical compartments 240, 242, 244, 246 and associated light sources 248, 250, 252, 254 and optical elements 256, 258, 260, 262. For instance, in one embodiment, the rear optical compartment 246 may be removed such that the optical housing 204 only includes the top, bottom, and front optical compartments 240, 242, 244. In another embodiment, the front optical compartment 244 may be removed such that the optical housing 204 only includes the top, bottom, and rear optical compartments 240, 242, 246.

Additionally, as indicated above, it should be appreciated that the various light sources 248, 250, 252, 254 may be controlled independently to provide the desired functionality for the disclosed lighting fixture 200. For instance, each light source 248, 250, 252, 254 may be independently activated or deactivated to allow the light source to be turned on/off in isolation or in combination with any of the other lights sources. Similarly, the power distribution to each light source 248, 250, 252, 254 may be independently controlled so as to provide the desired light output based on the intended function of the light source. For instance, in embodiments in which the first and second light sources 248, 250 serve as sources of ambient and reading light, respectively, and the third light source 252 serves as an examination light, the driving current supplied to such light sources 248, 250, 252 may differ to adjust the intensity of the light output of each light source. For instance, the driving current supplied to the third light source 252 may be controlled such that the third light source 252 provides a higher light intensity (e.g., an intensity of greater than about 100 foot-candles (fc)) than the light intensity provided by the first light source 248 (e.g., an intensity of less than about 20 fc) and the second light source 250 (e.g., an intensity ranging from about 10 fc to about 50 fc).

Similarly, in embodiments in which the fourth light source 254 is being used for light therapy, the operation of such light source 254 may be controlled so as to provide the desired color and/or time-variant color pattern. For instance, in one embodiment, the fourth light source 254 may include different colored LED devices and/or LED devices associated with different color temperatures spaced apart along the length of the light tray 272. In such an embodiment, the operation of the fourth light source 254 may be controlled such that the different LED devices 274 are selectively activated and/or deactivated to provide the desired color output. In such an embodiment, the operation of the fourth light source 254 may be controlled to provide the desired color and/or color temperature output.

It should be appreciated that the disclosed lighting fixture 200 may incorporate or be associated with any other suitable components and/or features. For example, the lighting fixture 200 may incorporate a pull-chain (not shown) to provide an efficient means for switching the lighting fixture 200 between its differing lighting modes. In addition, for healthcare applications, the lighting fixture 200 may include a bed stop switch lever arm (not shown) that is connected to the outlet into which the patient's bed is plugged to provide a safety feature for shutting off the functionality of the bed in the event that an object is being pushed against the lighting fixture 200 as the bed position/orientation is being adjusted.

Referring now to FIG. 8, a close-up view of a portion of the optical housing 204 shown in FIG. 7 is illustrated in accordance with aspects of the present subject, particularly illustrating the first light source 248, the top optical compartment 240, and the top optical element 256. As indicated above, in several embodiments, each light source 248, 250, 252, 254 may include a plurality of LED devices 270 arranged or otherwise supported on a light tray 272. As shown in FIG. 8, in one embodiment, each light tray 272 may include a retention feature configured to mate with a corresponding retention feature formed by a portion of the inner structure 218 of the optical housing 204. For example, in the illustrated embodiment, the light tray 272 includes a planar tray portion 280 and first and second flange hooks 282, 284 extending outwardly from the tray portion 280 such that a "T-shaped" channel 286 (FIG. 10) is defined between the flange hooks 282, 284. In such an embodiment, the inner structure 218 of the optical housing 204 may include or define a corresponding "T-shaped" projection 288 configured to be received within the channel 286. As such, the engagement of the flange hooks 282, 284 with the projection 288 may serve to retain the light source 248 relative to the remainder of the optical housing 204.

It should be appreciated that, in other embodiments, the flange hooks 282, 284 may be formed on the inner structure 218 of the optical housing 204 while the projection 288 may extend outwardly from the tray portion 280 of the light tray 272. Similarly, it should be appreciated that the mating retention features (e.g., the hooks/projection 282, 284, 288) may have any other suitable shape that allows the light tray 272 to be engaged with a portion of the inner structure 218 of the optical housing 204.

Additionally, by providing the same or similar mating retention features as that shown in FIG. 8, the light sources 248, 250, 252, 254 may be configured to be installed within and/or removed from the optical housing 204 by sliding the light trays 272 relative to the inner structure 218 of the optical housing 204 along its lengthwise direction 274. For instance, FIGS. 9 and 10 illustrate views showing a process for removing the light sources 248, 250, 252, 254 from the optical housing 204. Specifically, as shown in FIG. 9, one of the end covers (e.g., the second end cover 226) may be removed from the adjacent mounting bracket 222 to provide access to a cover pad 290 (e.g., felt cover pad) installed relative to the support bracket 222. For example, the lighting fixture 200 may include a cover pad 290 positioned at each end 208 of the optical housing 204 to cover the optical compartments 240, 242, 244, 246. Thereafter, as shown in FIG. 10, the cover pad 290 may be removed to provide access to each light source 248, 250, 252, 254, which may then be slid outwardly relative to the optical housing 204 to facilitate its removal from the housing 204.

A similar process may be utilized to install the light sources 248, 250, 252, 254 within the optical housing 204. For example, with the end cover 226 and cover pad 290 removed, the end of each light source 248, 250, 252, 254 may be positioned relative to its corresponding optical compartment 240, 242, 244, 246 such that the retention features of the light source 248, 250, 252, 254 (e.g., the flange hooks 282, 284) are aligned within the corresponding retention features of the optical housing 204 (e.g., the projection 288). Each light source 248, 250, 252, 254 may then be slid relative to the optical housing 204 in the lengthwise direction 274 until the light source 248, 250, 252, 254 is fully installed within the housing 204. Thereafter, the cover pad 290 may be reinstalled relative to the optical housing 204, followed by installation of the end cover 226 relative to the adjacent mounting bracket 222.

Figure 11:
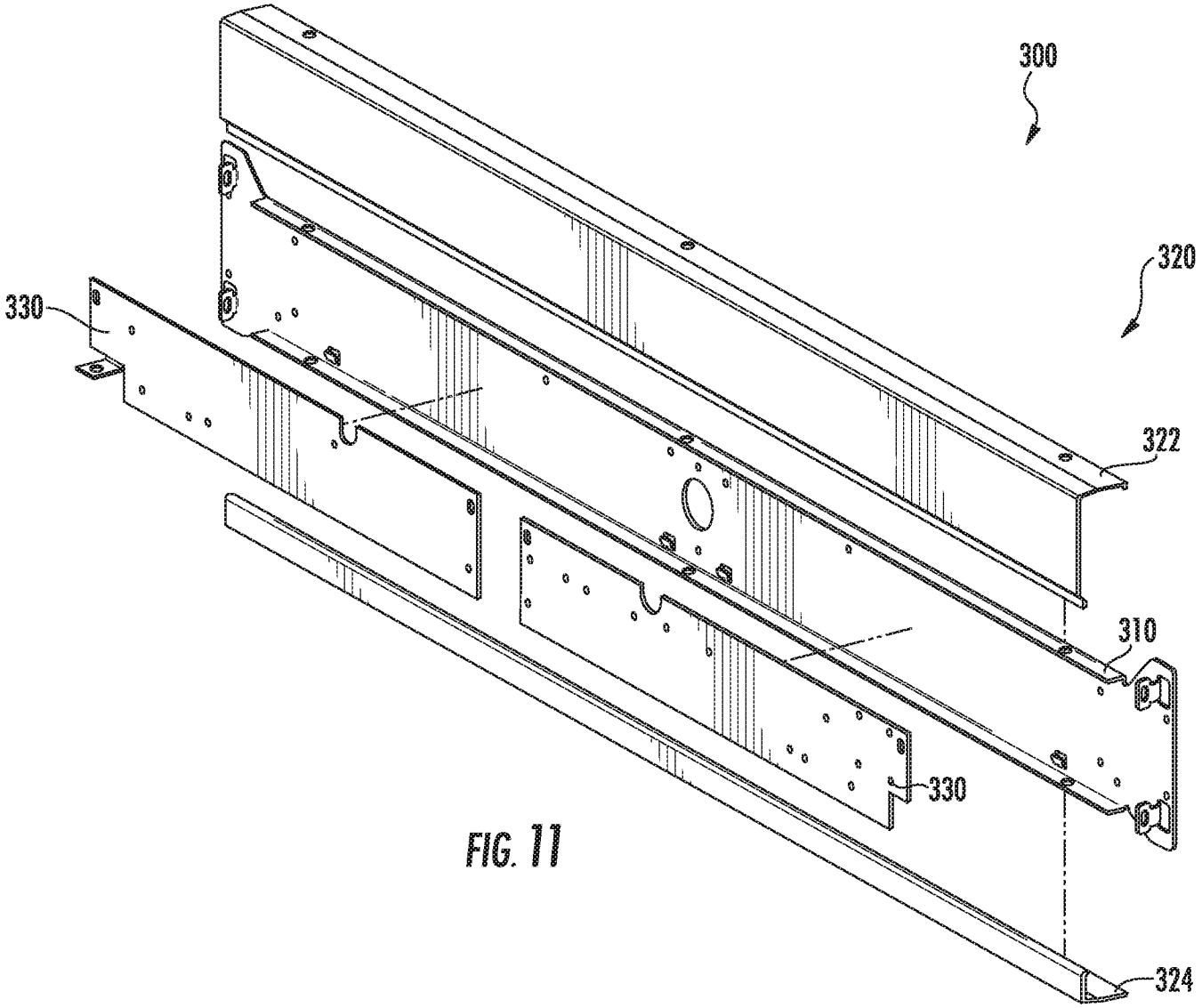
FIG. 11 depicts an example back plate according to example embodiments of the present disclosure.

FIG. 11 depicts aspects of an example back plate assembly 300 that can be used to secure a lighting fixture (e.g., lighting fixture 100 or lighting fixture 200) to a mounting surface according to example aspects of the present disclosure. The back plate assembly 300 can form a part of a secondary housing for the lighting fixture. The back plate assembly 300 can include a back plate 310 that can be secured to a mounting surface. The back plate assembly 300 can include a two-piece wire way cover 320 that includes two interlocking parts (e.g., a top portion 322 and a bottom portion 324) that are each fastened to the back plate 310. The top portion 322 can be removed for servicing and inspection of wiring. Once the fasteners securing the top portion 322 to the back plate 310 are removed, the top portion 322 can be pulled straight up and clear of the wire way.

The back plate assembly 300 can also include component plates 330. Each component plate 330 can have one or more electrical components (e.g., drivers, controllers, filters, etc.) mounted to the component plate 330. In some embodiments, a lower edge of the component plates 330 can lock into a tab located on the back plate 310 while the top edge is secured to the back plate 310 with one or more fasteners. The components plates 330 can be removed to facilitate servicing and/or replacement of electrical components.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A multi-function lighting fixture, comprising:

an optical housing extending lengthwise between a first end and a second end, the optical housing comprising a plurality of optical elements disposed along an exterior of the optical housing, the optical housing further comprising a plurality of optical compartments including a first optical compartment, a second optical compartment, and a third optical compartment defined within the interior of the optical housing, each of the plurality of optical compartments being associated with a separate optical element of the plurality of optical elements;

a plurality of light sources including a first light source arranged on a first tray disposed within the first optical compartment, a second light source arranged on a second tray disposed within the second optical compartment, and a third light source arranged on a third tray disposed within the third optical compartment;

a first mounting bracket coupled to the first end of the optical housing and a second mounting bracket coupled to the second end of the optical housing, the first mounting bracket and the second mounting bracket each being configured to support the optical housing relative to a mounting surface of the multi-function lighting fixture such that the optical housing is spaced laterally apart from the mounting surface; and a secondary housing directly coupled to the optical housing via at least the first mounting bracket and the second mounting bracket, the secondary housing extending lengthwise between the first mounting bracket and the second mounting bracket, the secondary housing extending laterally between the mounting surface and the optical housing, the secondary housing being spaced apart laterally from the optical housing such that an air gap is defined between the optical housing and the secondary housing, wherein the first tray includes a retention feature configured to engage a corresponding retention feature formed by an inner structure of the optical housing such that the first tray is slidable relative to the inner structure of the optical housing, and wherein at least one of the plurality of light sources is controlled to emit light at a different intensity than at least one other of the plurality of light sources.

2. The multi-function lighting fixture of claim 1, wherein the optical housing extends vertically between a top side and a bottom side and laterally between a front side and a rear side, the first optical compartment being defined adjacent to the top side of the optical housing such that light is directed through the first optical compartment and out of the top side of the optical housing, the second optical compartment being defined adjacent to the bottom side of the optical housing such that light is directed through the second optical compartment and out of the bottom side of the optical housing, the third optical compartment being defined adjacent to the front side of the optical housing such that light is directed through the third optical compartment and out of the front side of the optical housing.

3. The multi-function lighting fixture of claim 2, wherein the plurality of optical compartments further comprise a fourth optical compartment defined within the interior of the optical housing, the fourth optical compartment being defined adjacent to the rear side of the optical housing such that light is directed through the fourth optical compartment and out of the rear side of the optical housing.

4. The multi-function lighting fixture of claim 3, wherein the first, second, third, and fourth optical compartments are optically isolated from one another within the interior of the optical housing.

5. The multi-function lighting fixture of claim 1, wherein the secondary housing is configured to house at least one of electrical wiring, a power circuit, or a control device for the multi-function lighting fixture.

6. The multi-function lighting fixture of claim 1, wherein the secondary housing comprises a back plate assembly having one or more component plates and a two-piece wire way.

7. The multi-function lighting fixture of claim 1, wherein each optical compartment is at least partially defined by one or more sidewalls extending between the separate light source and the separate optical element associated with the optical compartment.

8. The multi-function lighting fixture of claim 7, wherein the one or more sidewalls include a reflective surface for reflecting light.

9. The multi-function lighting fixture of claim 1, further comprising:

a first end cover coupled to the first mounting bracket such that the first mounting bracket is positioned between the optical housing and the first end cover; and a second end cover coupled to the second mounting bracket such that the second mounting bracket is positioned between the optical housing and the second end cover.

10. The multi-function lighting fixture of claim 9, wherein at least one of the first end cover and the second end cover is removable relative to the optical housing to provide access to the plurality of light sources.

11. The multi-function lighting fixture of claim 9, wherein when the first end cover is decoupled from the first mounting bracket coupled to the first end of the optical housing, at least one of the first tray, the second tray and the third tray is configured to be slid outwardly relative to the interior structure of the optical housing.

12. The multi-function lighting fixture of claim 1, wherein the secondary housing extends lengthwise directly adjacent to the mounting surface.

13. The multi-function lighting fixture of claim 3, wherein the first optical housing is configured to provide ambient light for a space, wherein the second optical housing is configured to provide examination light for a patient bed; wherein the third optical housing is configured to provide reading light, wherein the fourth optical housing is configured to provide back light.

14. The multi-function lighting fixture of claim 13, wherein the first optical housing has one or more first optical elements, the second optical housing has one or more second optical element, the third optical housing has one or more third optical elements, and the fourth optical housing has one or more fourth optical elements;

wherein the one or more first optical elements comprises a diffuser optical element; wherein the one or more second optical elements comprises a linear prism optical element;

wherein the one or more third optical elements comprises a window lens optical element; and wherein the one or more fourth optical elements comprises a diffuser optical element.

15. The multi-function lighting fixture of claim 1, wherein:

the first tray, the second tray and the third tray each include a planar tray portion; and the retention feature comprises a first flange hook and a second flange hook, the first flange hook and the second flange hook each extending outwardly from the planar tray portion such that a channel is formed between the first flange hook and the second flange hook.

16. The multi-function lighting fixture of claim 15, wherein when the retention feature engages the corresponding retention feature formed by the inner structure of the optical housing, the corresponding retention feature is positioned within the channel.

17. The multi-function lighting fixture of claim 6, wherein the housing includes a support structure and wherein the first tray, second tray, and third tray slidably engage the support structure.

18. The multi-function lighting fixture of claim 17, wherein the plurality of optical elements slidably engage the support structure.

19. The multi-function lighting fixture of claim 6, further comprising a cover plate connected to the housing and positioned between the first mounting bracket and the first tray.

20. The multi-function lighting fixture of claim 19, wherein the cover plate is configured to slidably engage the retention feature formed by the inner structure of the optical housing.

* * * * *